US008337636B1

(12) United States Patent
Vance

(10) Patent No.: US 8,337,636 B1
(45) Date of Patent: Dec. 25, 2012

(54) POOL/SPA FILTER SAVER SYSTEM

(76) Inventor: Thomas L. Vance, Hudson, FL (US)

( * ) Notice: Subject to any disclaimer, the term of this patent is extended or adjusted under 35 U.S.C. 154(b) by 0 days.

(21) Appl. No.: 13/314,474

(22) Filed: Dec. 8, 2011

(51) Int. Cl.
*B08B 9/00* (2006.01)

(52) U.S. Cl. ..... 134/166 R

(58) Field of Classification Search ..... 134/166 R, 134/167 R, 168 R, 168 C, 167 C, 169 R, 134/166 C, 169 A, 169 C
See application file for complete search history.

(56) References Cited

U.S. PATENT DOCUMENTS

| | | | | |
|---|---|---|---|---|
| 4,103,943 | A * | 8/1978 | Curtin | 285/419 |
| 5,566,708 | A * | 10/1996 | Hobbs, Jr. | 137/360 |
| 5,573,187 | A * | 11/1996 | Proctor | 239/532 |
| 6,497,814 | B1 * | 12/2002 | Alexander et al. | 210/108 |
| 7,828,964 | B1 * | 11/2010 | Neibert | 210/167.12 |
| 7,963,462 | B1 * | 6/2011 | Ramos, Sr. | 239/222.15 |
| 2006/0060544 | A1 * | 3/2006 | Brooke | 210/791 |

* cited by examiner

*Primary Examiner* — Michael Barr
*Assistant Examiner* — David Cormier

(57) ABSTRACT

A first end of a connector is attached to the exterior end of a pipe. A second end of the connector is rotatably coupled with respect to the exterior end of the pipe and has female threads for removably receiving a hose. A spray head has a closed end, an open end coupled with respect to an interior end of the pipe, and an intermediate region having a plurality of radially extending micro-holes.

1 Claim, 2 Drawing Sheets

16
18
30
32
34
40
42
44
46
50
36
3
4

POOL/SPA FILTER SAVER SYSTEM

BACKGROUND OF THE INVENTION

Field of the Invention

The present invention relates to a pool/spa filter saver system and more particularly pertains to spraying the interior surface of a cylindrical paper filter to clean the filter of debris between uses of the filter, the spraying and cleaning being done in a safe, convenient and economical manner.

SUMMARY OF THE INVENTION

In view of the foregoing disadvantages inherent in the known types of filter systems of known designs and configurations now present in the prior art, the present invention provides an improved pool/spa filter saver system. As such, the general purpose of the present invention, which will be described subsequently in greater detail, is to provide a new and improved pool/spa filter saver system and method which has all the advantages of the prior art and none of the disadvantages.

To attain this, the present invention essentially comprises a pool/spa filter saver system. First provided is a cylindrical paper filter.

A rigid pipe is provided. The pipe has an interior end. The pipe has an exterior end. The pipe has a length of between 18 inches and 22 inches. The pipe has a diameter of between 0.5 inches and 1.0 inches. The pipe is adapted to function as a handle for the system during operation and use.

A pipe-to-hose connector is provided. The pipe-to-hose connector has a first end. The first end is attached to the exterior end of the pipe. The pipe-to-hose connector has a second end. The second end is rotatably coupled with respect to the exterior end of the pipe-to-hose connector. The second end is further rotatably coupled with respect to the exterior end of the pipe. The second end of the pipe-to-hose connector has female threads 26. In this manner the second end of the pipe-to-hose connector may be releasably coupled to a hose.

An adaptor/reducer is provided next. The adaptor/reducer has an interior surface. The interior surface is attached to the interior end of the pipe. The adaptor/reducer has an exterior surface. The exterior surface of the adaptor/reducer has a cylindrically shaped inner end. The exterior surface has a hexagonally shaped outer end. A radially extending abutment shoulder is provided. The abutment shoulder is formed between the inner end and the outer end of the exterior surface of the adaptor/reducer.

Further provided is a spray head. The spray head has a closed end. The closed end is in a generally hemispherical configuration. The spray head has an open end. The open end is in a cylindrical configuration. The spray head has a cylindrical intermediate region. The intermediate region is provided between the closed end and the open end. The spray head is hollow. The spray head has a common first thickness over the majority of its extent. The common first thickness is 0.01875 inches, plus or minus 10 percent. The spray head has a second thickness adjacent to the open end. The second thickness is greater than the first thickness. The interior surface of the adaptor/reducer is received upon and attached to the interior end of the pipe. The open end of the spray head is received upon and attached to the inner end of the adaptor/reducer. The open end of the spray head is provided in contact with the abutment shoulder of the adaptor/reducer.

Provided last is a plurality of micro-holes. The micro-holes are provided in the intermediate region adjacent to the open end. The micro-holes extend radially through the spray head. Each micro-hole has a diameter. The diameter is between 0.015625 inches and 0.03125 inches. The micro-holes are located in two axially spaced rings. The micro-holes are separated from each other circumferentially by between 6 degrees and 12 degrees.

The pipe and pipe-to-hose connector and adaptor/reducer and spray head are fabricated of polyvinyl chloride. The system includes cement/glue. In this manner the pipe and pipe-to-hose connector and adaptor/reducer and spray head are attached together. In this manner water introduced into the system by the hose coupled to the pipe-to-hose connector is fed through the pipe into the spray head and through the micro-holes to project a spray of cleansing water into the cylindrical filter to be cleaned.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pool/spa filter saver system which has all of the advantages of the prior art filter systems of known designs and configurations and none of the disadvantages.

It is another object of the present invention to provide a new and improved pool/spa filter saver system which may be easily and efficiently manufactured and marketed.

It is further object of the present invention to provide a new and improved pool/spa filter saver system which is of durable and reliable constructions.

An even further object of the present invention is to provide a new and improved pool/spa filter saver system which is susceptible of a low cost of manufacture with regard to both materials and labor, and which accordingly is then susceptible of low prices of sale to the consuming public, thereby making such pool/spa filter saver system economically available to the buying public.

Even still another object of the present invention is to provide a pool/spa filter saver system for spraying the interior surface of a cylindrical paper filter to clean the filter of debris between uses of the filter, the spraying and cleaning being done in a safe, convenient and economical manner.

Lastly, it is an object of the present invention to provide a new and improved pool/spa filter saver system having a first end of a connector attached to an exterior end of a pipe. A second end of the connector is rotatably coupled with respect to the exterior end of the pipe and has female threads for removably receiving a hose. A spray head has a closed end, an open end coupled with respect to an interior end of the pipe, and an intermediate region having a plurality of radially extending micro-holes These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
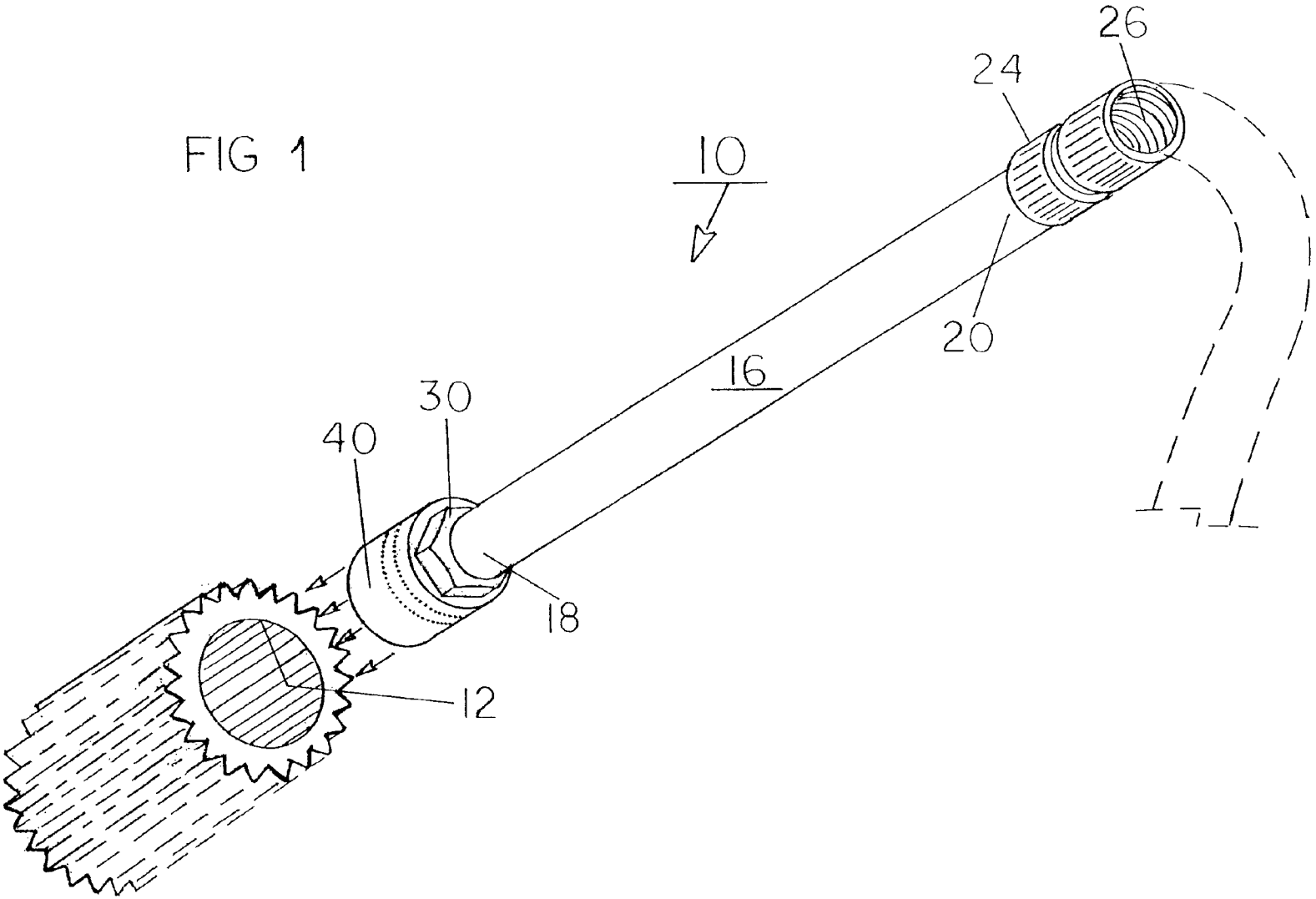
FIG. 1 is a perspective illustration of a pool/spa filter saver system constructed in accordance with the principles of the present invention.
Figures 2, 3, 4:
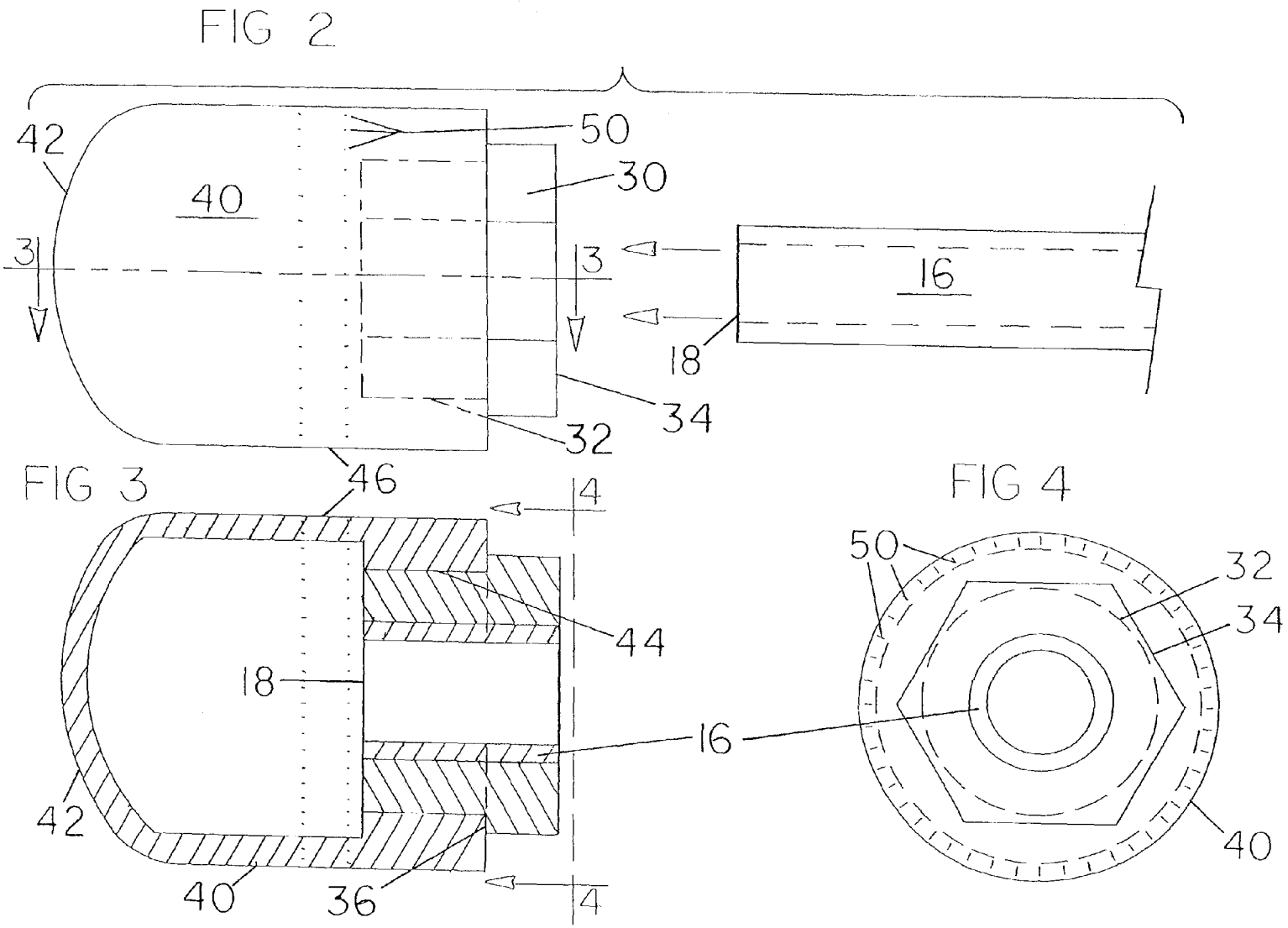
FIG. 2 is an exploded side elevational view of the interior end of the system shown in FIG. 1.
FIG. 3 is a cross sectional view taken along line 3-3 of FIG. 2.
FIG. 4 is an end elevational view taken along line 4-4 of FIG. 3.

With reference now to the drawings, and in particular to FIG. 1 thereof, the preferred embodiment of the new and improved pool/spa filter saver system embodying the principles and concepts of the present invention and generally designated by the reference numeral 10 will be described.

The present invention, the pool/spa filter saver system 10 is comprised of a plurality of components. Such components in their broadest context include a pipe, a connector, a spray head and radially extending micro-holes. Such components are individually configured and correlated with respect to each other so as to attain the desired objective.

First provided is a cylindrical paper filter 12.

A rigid pipe 16 is provided. The pipe has an interior end 18. The pipe has an exterior end 20. The pipe has a length of between 18 inches and 22 inches. The pipe has a diameter of between 0.5 inches and 1.0 inches. The pipe is adapted to function as a handle for the system during operation and use.

A pipe-to-hose connector 24 is provided. The pipe-to-hose connector has a first end. The first end is attached to the exterior end of the pipe. The pipe-to-hose connector has a second end. The second end is rotatably coupled with respect to the first end of the pipe-to-hose connector. The second end is further rotatably coupled with respect to the exterior end of the pipe. The second end of the pipe-to-hose connector has female threads 26. In this manner the second end of the pipe-to-hose connector may be releasably coupled to a hose.

An adaptor/reducer 30 is provided next. The adaptor/reducer has an interior surface. The interior surface is attached to the interior end of the pipe. The adaptor/reducer has an exterior surface. The exterior surface of the adaptor/reducer has a cylindrically shaped inner end 32. The exterior surface has a hexagonally shaped outer end 34. A radially extending abutment shoulder 36 is provided. The abutment shoulder is formed between the inner end and the outer end of the exterior surface of the adaptor/reducer.

Further provided is a spray head 40. The spray head has a closed end 42. The closed end is in a generally hemispherical configuration. The spray head has an open end 44. The open end is in a cylindrical configuration. The spray head has a cylindrical intermediate region. The intermediate region is provided between the closed end and the open end. The spray head is hollow. The spray head has a common first thickness over the majority of its extent. The common first thickness is 0.01875 inches, plus or minus 10 percent. The spray head has a second thickness adjacent to the open end. The second thickness is greater than the first thickness. The interior surface of the adaptor/reducer is received upon and attached to the interior end of the pipe. The open end of the spray head is received upon and attached to the inner end of the adaptor/reducer. The open end of the spray head is provided in contact with the abutment shoulder of the adaptor/reducer.

Provided last is a plurality of micro-holes 48. The micro-holes are provided in the intermediate region adjacent to the open end. The micro-holes extend radially through the spray head. Each micro-hole has a diameter. The diameter is between 0.015625 inches and 0.03125 inches. The micro-holes are located in two axially spaced rings. The micro-holes are separated from each other circumferentially by between 6 degrees and 12 degrees.

The pipe and pipe-to-hose connector and adaptor/reducer and spray head are fabricated of polyvinyl chloride. The system includes cement/glue. In this manner the pipe and pipe-to-hose connector and adaptor/reducer and spray head are attached together. In this manner water introduced into the system by the hose coupled to the pipe-to-hose connector is fed through the pipe into the spray head and through the micro-holes to project a spray of cleansing water into the cylindrical filter to be cleaned.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A pool/spa filter saver system (10) for spraying the interior surface of a cylindrical paper filter (12) to clean the filter of debris between uses of the filter, the spraying and cleaning being done in a safe, convenient and economical manner, the system comprising, in combination:

a rigid pipe (16) having an interior end (18) and an exterior end (20), the pipe having a length of between 18 inches and 22 inches, the pipe having a diameter of between 0.5 inches and 1.0 inches, the pipe adapted to function as a handle for the system during operation and use;

a pipe-to-hose connector (24) having a first end attached to the exterior end of the pipe, the pipe-to-hose connector having a second end rotatably coupled with respect to the first end of the pipe-to-hose connector and to the exterior end of the pipe, the second end of the pipe-to-hose connector having female threads (26) for releasably coupling to a hose;

an adaptor/reducer (30) having an interior surface attached to the interior end of the pipe, the adaptor/reducer having an exterior surface, the exterior surface of the adaptor/reducer having a cylindrically shaped inner end (32) and a hexagonally shaped outer end (34), a radially extending abutment shoulder (36) formed between the inner end and the outer end of the exterior surface of the adaptor/reducer;

a spray head (40) having a closed end (42) in a generally hemispherical configuration, the spray head having an open end (44) in a cylindrical configuration, the spray head having a cylindrical intermediate region between the closed end and the open end, the spray head being hollow with a common first thickness of 0.01875 inches, plus or minus 10 percent, over the majority of its extent and with a second thickness adjacent to the open end, the second thickness being greater than the first thickness, the interior surface of the adaptor/reducer being received upon and attached to the interior end of the pipe, the open end of the spray head being received upon and attached to the inner end of the adaptor/reducer, the open end of the spray head being in contact with the abutment shoulder of the adaptor/reducer; and a plurality of micro-holes (48) in the intermediate region closer to the open end than to the closed end of the spray head, the micro-holes extending radially through the spray head, each micro-hole having a diameter of between 0.015625 inches and 0.03125 inches, the micro-holes being located in two axially spaced rings, the micro-holes being separated from each other circumferentially by between 6 degrees and 12 degrees, the pipe and pipe-to-hose connector and adaptor/reducer and spray head being fabricated of polyvinyl chloride, the system including cement/glue to attach together the pipe and pipe-to-hose connector and adaptor/reducer and spray head whereby water introduced into the system by the hose coupled to the pipe-to-hose connector is fed through the pipe into the spray head and through the micro-holes to project a spray of cleansing water into the cylindrical filter to be cleaned.

* * * * *